US009353538B1

(12) United States Patent
Kelley

(10) Patent No.: US 9,353,538 B1
(45) Date of Patent: May 31, 2016

(54) STIFFENING STRUT FOR GARAGE DOOR PANELS

(71) Applicant: Robert A. Kelley, Orange, CA (US)

(72) Inventor: Robert A. Kelley, Orange, CA (US)

(73) Assignee: Unique Garage Door Inc., Buena Park, CA (US)

( * ) Notice: Subject to any disclaimer, the term of this patent is extended or adjusted under 35 U.S.C. 154(b) by 0 days.

(21) Appl. No.: 13/726,156

(22) Filed: Dec. 23, 2012

(51) Int. Cl.
*E04G 23/00* (2006.01)
*E04G 25/00* (2006.01)

(52) U.S. Cl.
CPC ..... *E04G 25/00* (2013.01)

(58) Field of Classification Search
CPC ..... E04C 2003/023; E04C 2003/026; E04C 2003/0473; E04C 3/32; E04C 3/04; E04C 2003/0421; E04C 3/0434; E06B 1/522; E06B 1/00
USPC ..... 52/97, 204.2, 211, 573.1, 836, 846, 52/851, 852; 49/197
See application file for complete search history.

(56) References Cited

U.S. PATENT DOCUMENTS

| | | | | |
|---|---|---|---|---|
| 2,285,011 | A * | 6/1942 | Buehler | 49/197 |
| 5,749,407 | A * | 5/1998 | Brenner et al. | 160/229.1 |
| 6,073,414 | A * | 6/2000 | Garris et al. | 52/846 |
| 6,161,606 | A * | 12/2000 | Wegner et al. | 160/229.1 |
| D560,000 | S * | 1/2008 | Hernandez | D25/61 |
| 7,874,342 | B2 * | 1/2011 | Mullet et al. | 160/201 |
| 2012/0111508 | A1 * | 5/2012 | Wedekind | 160/127 |

* cited by examiner

*Primary Examiner* — Mark Wendell
(74) *Attorney, Agent, or Firm* — Thomas I. Rozsa

(57) ABSTRACT

A stiffening strut to be used in conjunction with a rear surface of a garage door panel having a given width-wise length, formed in a generally U-shaped body. First and second sidewalls each with a bottom side edge and a top side edge, a front edge and a rear edge, the bottom side edge extends to first lengthwise mounting sleeve having an interior edge aligned with said bottom side edge, the first mounting sleeve having an outer edge parallel to the inner edge, the first lengthwise mounting sleeve having a given width, the first lengthwise mounting sleeve having a multiplicity of spaced apart openings by which fastening means affix the stiffening strut to the top of a garage door panel.

4 Claims, 6 Drawing Sheets

STIFFENING STRUT FOR GARAGE DOOR PANELS

BACKGROUND OF THE INVENTION

1. Field of the Invention

The field of the present invention relates to stiffening struts which are affixed to an uppermost panel of a garage door to reduce the risk of the garage door panels buckling or bending due to the frequent up and down motion of the panels resulting from opening and closing the garage door.

2. Description of the Prior Art

The present invention relates to the field of garage doors which in the prior art include several horizontally aligned panel sections, each horizontally aligned panel section extending for the width of a garage opening and rollably affixed to a rail on each width-wise side of the panel, the panel having stamped decorations therein and spaced apart stiffening stiles extending for the entire vertical height of the panel section. The stiffening stiles are adjacent each respective end of a panel section and at a midpoint of a panel section. Alternatively, additional stiffening stiles are at spaced apart locations between the midpoint and end of a panel section.

A garage door includes a multiplicity of rectangular panel sections affixed one on top of the other and having adjacent horizontally extending edges hingeably connected to permit movement of the garage door between a closed substantially vertical position when the multiplicity of rectangular panel sections is used for closing a garage door opening and an open substantially horizontal position when the multiplicity of panels is raised along the tracks by either mechanical lifting effort or a motorized garage door opener, so that the garage is open.

Due to the frequent up and down motion of the sections of garage door panels to move from the closed to the opened position, the panel sections, usually made of metal such as aluminum or steel, can buckle or bend. As a result, a stiffening strut is affixed to the back of the garage door panel, usually adjacent the top of the uppermost panel section. The struts in use today for residential garage doors are usually 2 inches to 2⅛ inches high and are made of out of 22 gauge steel. The struts are smooth and extend for the entire width of the panel so that the strut weighs 10 to 12 pounds.

Conventional struts are inherently weak and do not always prevent the garage door panel from buckling or twisting. There is a significant need for an improved strut for a garage door panel strut.

SUMMARY OF THE INVENTION

The present invention is an improved stiffening strut located adjacent the back and top of the upper garage door panel section to provide extra strength to the garage door as it goes up and down to open and close the opening to the garage. The stiffening strut is used to reduce the incidence of the garage door buckling or bending due to the frequent up and down motion of the garage door.

The improved stiffening strut extends for the entire width of the uppermost panel section and is affixed to reinforcing stiles positioned on the upper panel section, extending for the entire height of the uppermost panel section, and located at oppose ends of the panel section, at a midpoint of the panel section, and at spaced apart locations between an end and a midpoint of the panel section.

Stiffening struts have existed in the prior art but there is a significant need for an improved stiffening strut. The improvements of the present invention stiffening strut are as follows:

(1) The stiffening strut is preferably made of 24 gauge steel, providing a stiffening strut that weighs 8.8 pounds, between 1.2 pounds and 3.2 pounds lighter than prior art struts;

(2) The stiffening strut is generally U-shaped with a pair of lengthwise oppositely disposed attaching strips, the height of the "U; shaped section increased to 2½ inches to provide improved strength. The variance can go from 2 inches to 3 inches for height, but 2½ inches is preferred;

(3) The walls of the U-shaped section of the stiffening strut comprise two spaced apart stiffening channels or stiffening ribs on each wall which increases the strength of the stiffening strut by twenty percent. It is within the spirit and scope of the present invention for there to be at least one stiffening rib or channel on each wall of the generally "U"-shaped section, but two spaced apart stiffening ribs or channels on each wall is preferred. The stiffening channels are preferably inwardly extending but it is also within the spirit and scope of the present invention for the stiffening channels to be outwardly extending. A top stiffening rib or stiffening channel can be included at the upper portion of the generally "U"-shaped section where the "U" turns from one wall to the opposite wall. The top stiffening channel is preferably inwardly extending but an also be outwardly extending.

It is therefore an object of the present invention top provide an improved stiffening strut for residential garage doors which are lighter and stronger than the prior art struts to prevent bending and buckling of the garage door.

Making the stiffening strut out of 24 gauge steel instead of 22 gauge steel reduces the manufacturing cost of the stiffening strut while at the same time providing a stronger and better stiffening strut as opposed to prior art stiffening struts which are shorter and do not have stiffening channels or ribs.

Further novel features and other objects of the present invention will become apparent from the following detailed description, discussion and the appended claims, taken in conjunction with the drawings.

BRIEF DESCRIPTION OF THE DRAWINGS

Referring particularly to the drawings for the purpose of illustration only and not limitation, there is illustrated.

DETAILED DESCRIPTION OF THE PREFERRED EMBODIMENTS

Although specific embodiments of the present invention will now be described with reference to the drawings, it should be understood that such embodiments are by way of example only and merely illustrative of but a small number of the many possible specific embodiments which can represent applications of the principles of the present invention. Various changes and modifications obvious to one skilled in the art to which the present invention pertains are deemed to be within the spirit, scope and contemplation of the present invention as further defined in the appended claims.

Figure 1:
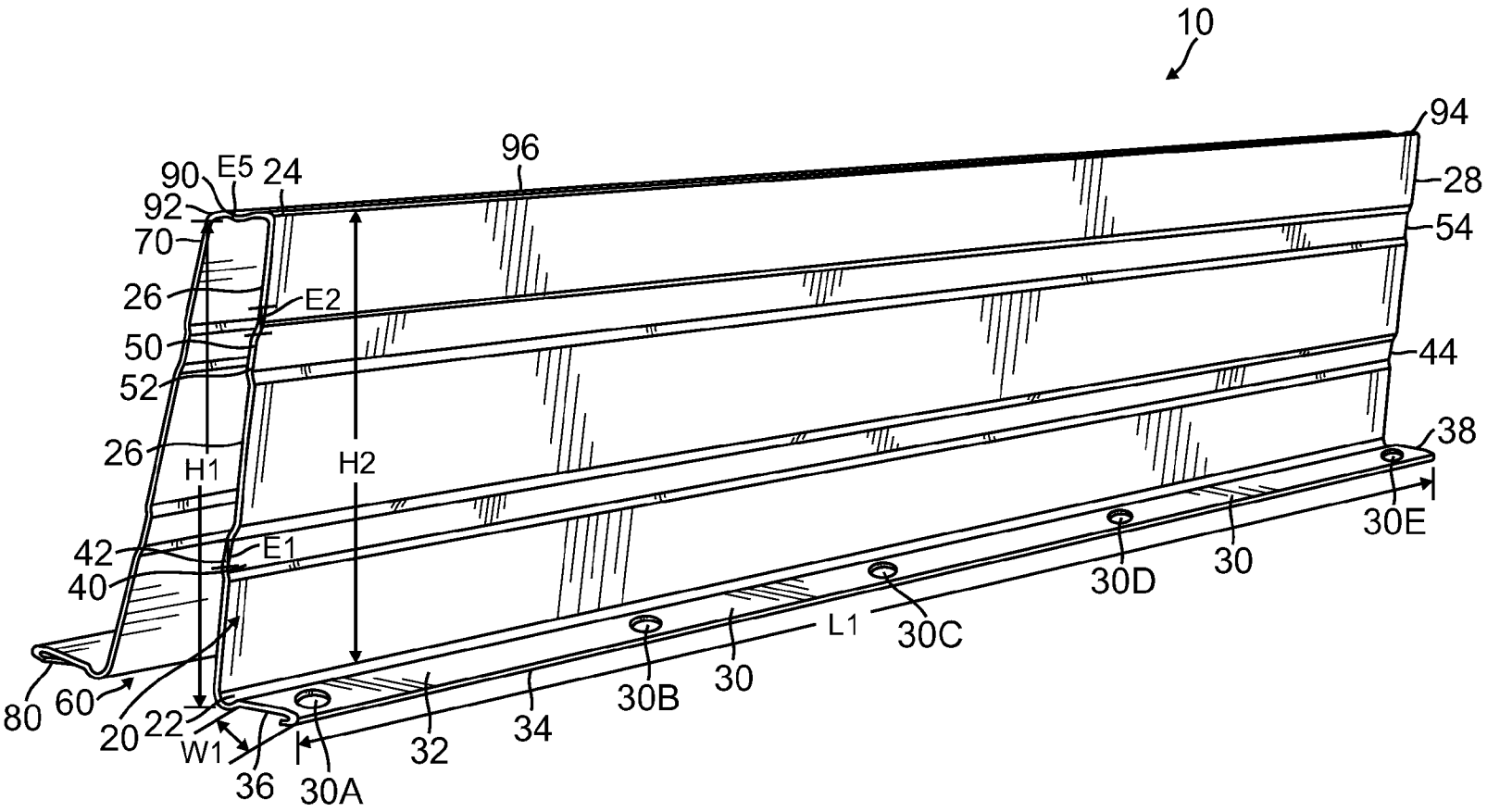
FIG. 1 is a perspective view from the right side of a preferred embodiment of the present invention stiffening strut for a garage door panel.

Referring to FIG. 1, there is illustrated a perspective of a preferred embodiment of the present invention stiffening strut 10. The stiffening strut 10 is generally U-shaped having a given height "H1" is preferably two and one-half (2½) inches but can range from two (2) inches to three (3) inches. The stiffening strut 10 has a given length "L1" which is designed to be the same as the width of a garage door panel. Most conventional residential garage door panels are sixteen (16) feet, therefore "L1" is also preferably sixteen (16) feet. The length "L1" can be matched to the given width of any residential garage door panel.

The stiffening strut 10 has a first sidewall 20 with a bottom side edge 22 and a top side edge 24, a front edge 26 and a rear edge 28. Bottom side edge 22 extends to first lengthwise mounting sleeve 30 having an interior edge 32 aligned with bottom side edge 22, a front edge 36 aligned with front edge 26 and a rear edge 38 aligned with rear edge 28. Mounting sleeve 30 has an outer edge 34 parallel to inner edge 32. First lengthwise mounting sleeve 30 has a given width "W1" which can range from one-quarter (¼) inch to one half (½) inch. First lengthwise mounting sleeve 30 has a multiplicity of spaced apart openings, with a first opening 30A adjacent front edge 36, a fifth opening 30E adjacent rear edge 38, a middle opening 30C at a midpoint along lengthwise mounting sleeve 30 and a second opening 30B between openings 30A and 30C and a fourth opening 30D between openings 30C and 30E.

A key innovation is the incorporation of a pair of parallel spaced apart longitudinal stiffening channels or ribs 40 and 50 spaced at locations approximately one third and two thirds of the height "H2" of the first wall 20. Stiffening channel 40 has a front edge 42 aligned with front edge 26, a rear edge 44 aligned with rear edge 28 and extending inwardly toward interior opening 60 of stiffening strut 10 by a distance "E1". Stiffening channel 50 has a front edge 52 aligned with front edge 26 and a rear edge 54 aligned with rear edge 28 and extending inwardly toward interior opening 60 of stiffening strut 10 by a distance "E2". In general "E1" and "E2" can each range from one sixteenth (1/16) inch to one-eighth (⅛) inch.

Figure 2:
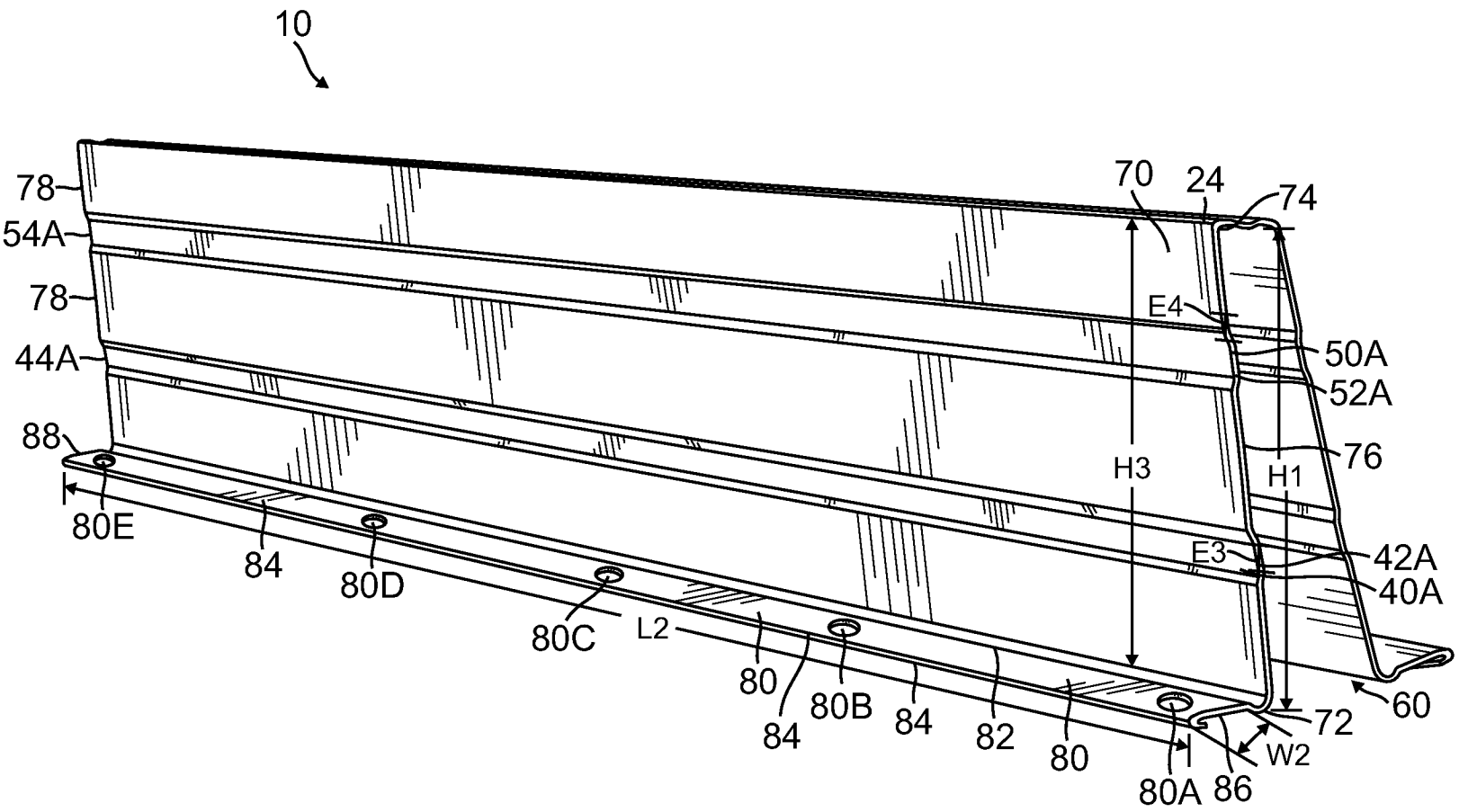
FIG. 2 is a perspective view from the left side of a preferred embodiment of the present invention stiffening strut for a garage door panel.

Referring to FIG. 2, a parallel second wall 70 and second lengthwise mounting 80 is a mirror image of first wall 20 and first lengthwise mounting sleeve 30. As shown in FIGS. 1 and 2, the stiffening strut 10 has a second sidewall 70 with a bottom side edge 72 and a top side edge 74, a front edge 76 and a rear edge 78. Bottom side edge 72 extends to first lengthwise mounting sleeve 80 having an interior edge 82 aligned with bottom side edge 72, a front edge 86 aligned with front edge 76 and a rear edge 88 aligned with rear edge 78. Mounting sleeve 80 has an outer edge 84 parallel to inner edge 82. With a length "L2" which is the same as length "L1". First lengthwise mounting sleeve 80 has a given width "W2" which can range from one-quarter (¼) inch to one half (½) inch. First lengthwise mounting sleeve 80 has a multiplicity of spaced apart openings, with a first opening 80A adjacent front edge 86, a fifth opening 80E adjacent rear edge 88, a middle opening 80C at a midpoint along lengthwise mounting sleeve 80 and a second opening 80B between openings 80A and 80C and a fourth opening SOD between openings 80C and 80E.

A key innovation is the incorporation of a pair of parallel spaced apart longitudinal stiffening channels or ribs 40A and 50A spaced at locations approximately one third and two thirds of the height "H3" of the second wall 70. Stiffening channel 40A has a front edge 42A aligned with front edge 76, a rear edge 44A aligned with rear edge 78 and extending inwardly toward interior opening 60 of stiffening strut 10 by a distance "E3". Stiffening channel 50A has a front edge 52A aligned with front edge 26 and a rear edge 54A aligned with rear edge 28A and extending inwardly toward interior opening 60 of stiffening strut 10 by a distance "E4". In general "E3" and "E4" can each range from one-sixteen (1/16) to one eighth (⅛) inch.

Walls 20 and 70 respectively extend to top 90 having a front edge 92 aligned with front edges 26 and 76 and a rear edge 94 aligned with rear edges 28 and 78. Top 90 has a stiffening channel or rib 96 extending from the front edge 92 to the rear edge 94 and extending inwardly or downwardly into opening 60 by a distance "E5" which can be one-sixteenth inch (1/16) to one-eighth (⅛) inch.

The stiffening strut made of 24 gauge steel, being two and one-half (2½) inches in height "H1" combined with the "U"-shaped struts including walls 20 and 70 with stiffening channel or ribs 40, 50, 40A and 50A and optionally a top 90 with stiffening channel 96 provide for a strong lightweight stiffening strut affixed to a garage door panel. It is also within the spirit and scope of the present invention to have only one stiffening channel or rib 40 and 40A in each respective sidewall 20 and 70. The stiffening channel or rib would then be respectively in the center of each respective wall 20 and 70.

Figure 3:
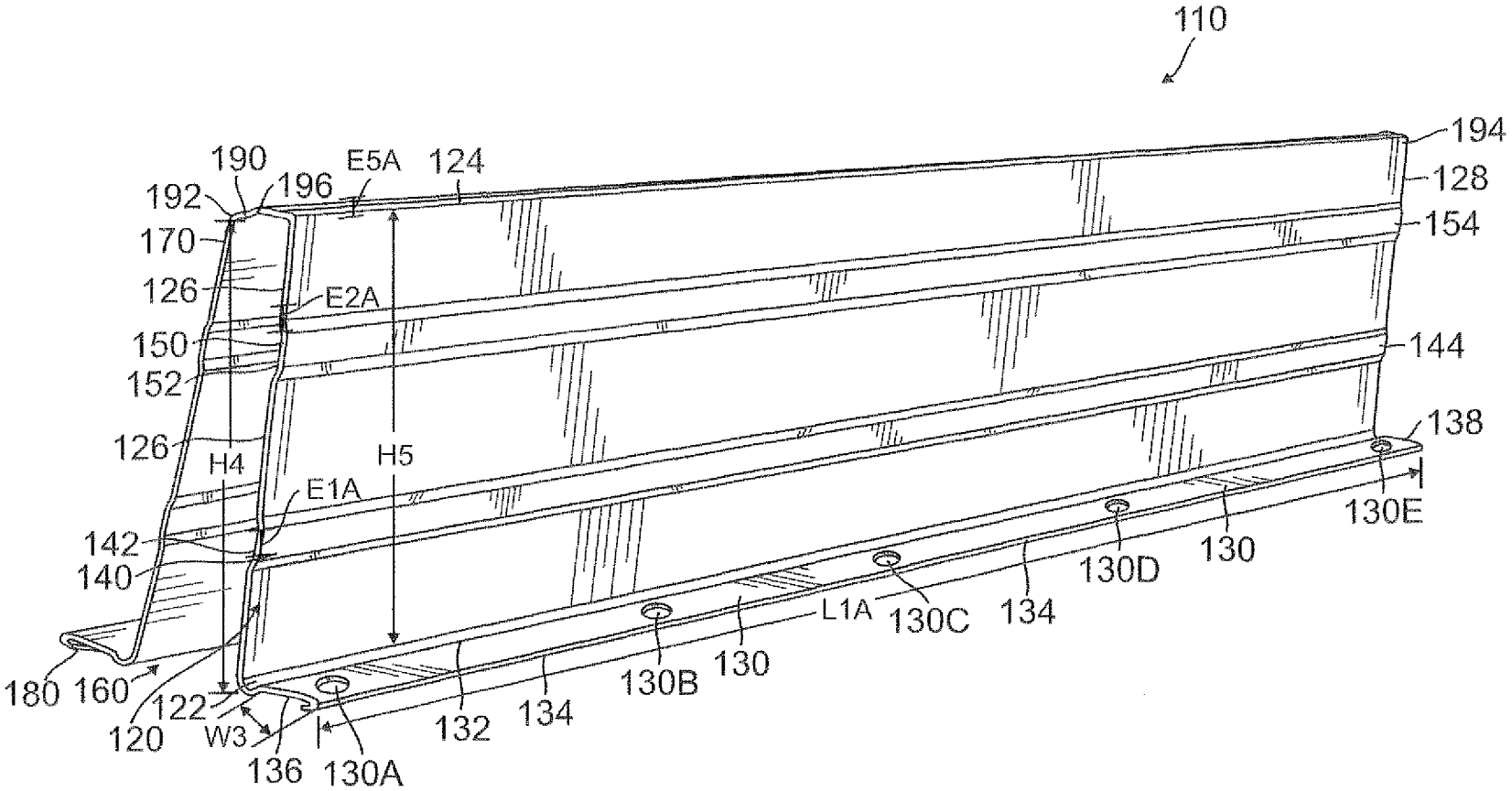
FIG. 3 is a perspective view from the right side of an alternative embodiment of the present invention stiffening strut for a garage door panel.
Figure 4:
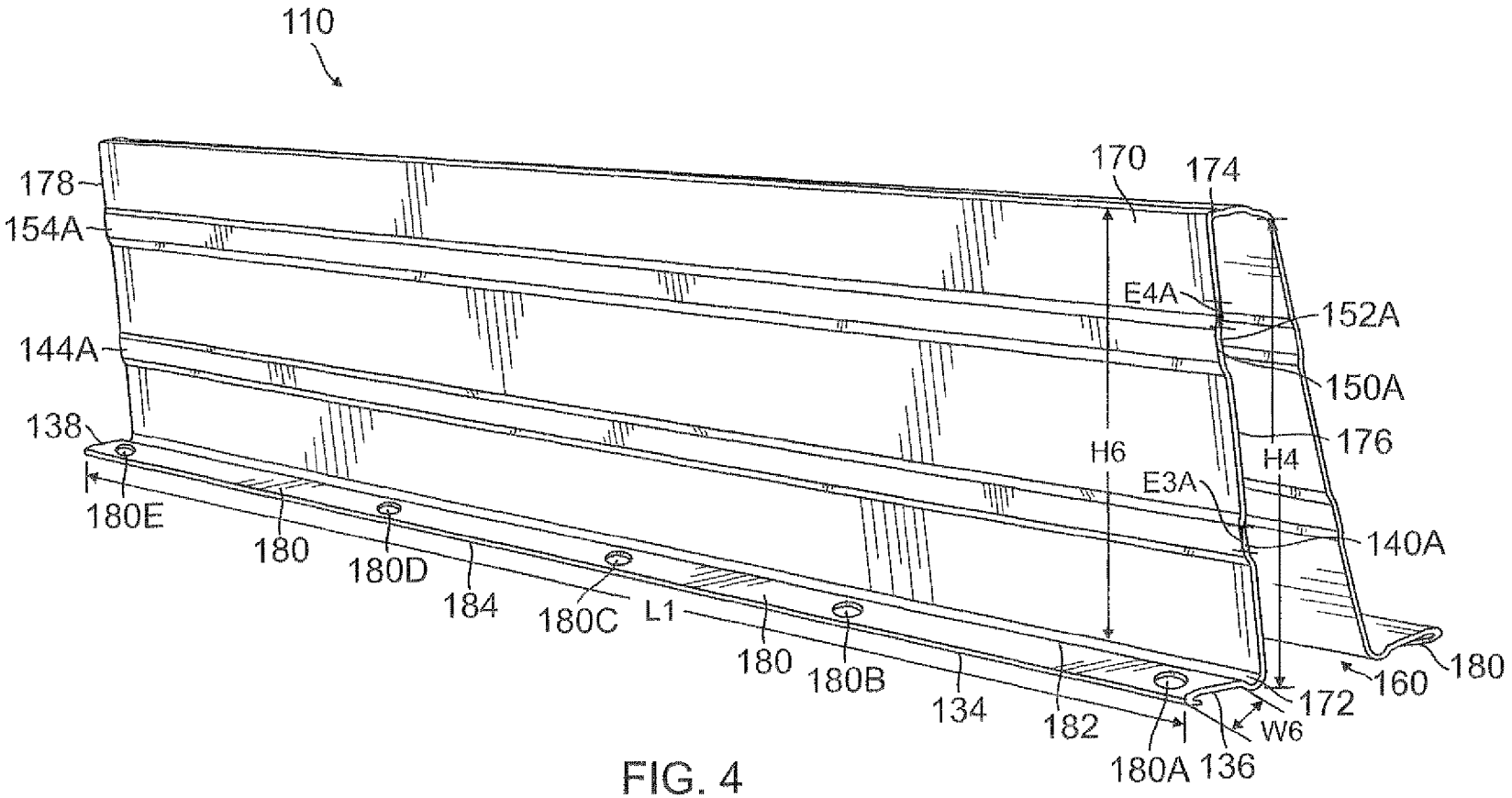
FIG. 4 is a perspective view from the left side of an alternative embodiment of the present invention stiffening strut for a garage door panel.

As illustrated in FIGS. 3 and 4, an alternative embodiment of a stiffening strut 110 is the same as preferred embodiment 10 except that the stiffening channels "E1A", "E2A", "E3A", "E4A" and "E5A" extend outwardly instead of inwardly.

Referring to FIGS. 3 and 4, there is illustrated a perspective of a alternative embodiment of the present invention stiffening strut 110. The stiffening strut 110 is generally "U"-shaped having a given height "H4" and is preferably two and one-half.

(2½) inches but can range from two (2) inches to three (3) inches. The stiffening strut 110 has a given length "L1A" which is designed to be the same as the width of a garage door panel. Most conventional residential garage door panels are sixteen (16) feet. Therefore, "L1A" is also preferably sixteen (16) feet. The length "L1A" can be matched to the given width of any residential garage door panel.

The stiffening strut 110 has a first sidewall 120 with a bottom side edge 122 and a top side edge 124, a front edge 126 and a rear edge 128. Bottom side edge 122 extends to first lengthwise mounting sleeve 130 having an interior edge 132 aligned with bottom side edge 122, a front edge 136 aligned with front edge 126 and a rear edge 138 aligned with rear edge 128. Mounting sleeve 130 has an outer edge 134 parallel to inner edge 132. First lengthwise mounting sleeve 130 has a given width "W3" which can range from one-quarter (¼) inch to one half (½) inch. First lengthwise mounting sleeve 130 has a multiplicity of spaced apart openings, with a first opening 130A adjacent front edge 136, a fifth opening 130E adjacent rear edge 138, a middle opening 130C at a midpoint along lengthwise mounting sleeve 130 and a second opening 130B between openings 130A and 130C and a fourth opening 130D between openings 130C and 130E.

A key innovation is the incorporation of a pair of parallel spaced apart longitudinal stiffening channels or ribs 140 and 150 spaced at locations approximately one-third and two-thirds of the height "H5" of the first wall 20. Stiffening channel 40 has a front edge 142 aligned with front edge 126, a rear edge 144 aligned with rear edge 128 and extending outwardly away from interior opening 160 of stiffening strut 110 by a distance "E1A". Stiffening channel 150 has a front edge 152 aligned with front edge 126 and a rear edge 154 aligned with rear edge 128 and extending outwardly away from interior opening 160 of stiffening strut 110 by a distance "E2A". In general "E1A" and "E2A" can each range from one-sixteenth (1/16) to one-eighth (1/8) inch.

A parallel second wall 170 and second lengthwise mounting sleeve 180 is a mirror image of first wall 120 and first lengthwise mounting sleeve 130. As shown in FIG. 4, stiffening strut 110 has a second sidewall 170 with a bottom side edge 172 and a top side edge 174, a front edge 176 and a rear edge 178. Bottom side edge 172 extends to first lengthwise mounting sleeve 180 having an interior edge 182 aligned with bottom side edge 182, a front edge 186 aligned with front edge 186 and a rear edge 188 aligned with rear edge 88. Mounting sleeve 180 has an outer edge 184 parallel to inner edge 182. First lengthwise mounting sleeve 180 has a given width "W6" which can range from one-quarter (1/4) inch to one-half (1/2) inch. First lengthwise mounting sleeve 180 has a multiplicity of spaced apart openings, with a first opening 180A adjacent front edge 186, a fifth opening 180E adjacent rear edge 188, a middle opening 180C at a midpoint along lengthwise mounting sleeve 180 and a second opening 180E between openings 180A and 180C and a fourth opening 180D between openings 180C and 180E.

A key innovation is the incorporation of a pair of parallel spaced apart longitudinal stiffening channels or ribs 140A and 150A spaced at locations approximately one-third and two-thirds of the height "H6" of the second wall 170. Stiffening channel 140A has a front edge 142A aligned with front edge 176, a rear edge 144A aligned with rear edge 178 and extending outwardly away from interior opening 160 of stiffening strut 110 by a distance "E3A". Stiffening channel 150A has a front edge 152A aligned with front edge 176 and a rear edge 154A aligned with rear edge 178 and extending outwardly away from interior opening 160 of stiffening strut 110 by a distance "E4A". In general "E3A" and "E4A" can each range from one-sixteenth (1/16) to one-eighth (1/8) inch.

Walls 120 and 170 respectively extend to top 190 having a front edge 192 aligned with front edges 126 and 176 and a rear edge 194 aligned with rear edges 128 and 178. Top 190 has a stiffening channel or rib 196 extending from the front edge 192 to the rear edge 194 and extending outwardly and upwardly away from opening 160 by a distance "E5A" which can be one-sixteenth inch (1/16) to one-eighth (1/8) inch.

The stiffening strut 110 is made of 24 gauge steel, being two and one-half (2½) inches in height combined with the U-shaped struts including walls 120 and 170 with stiffening channel or ribs 140, 150, 140A and 150A and optionally a top 190 with stiffening channel 196A provide for a strong lightweight stiffening strut affixed to a garage door panel. It is also within the spirit and scope of the present invention to have only one stiffening channel or rib 40 and 40A in each respective sidewall 120 and 170. The stiffening channel or rib would then be respectively in the center of each respective wall 120 and 170.

Figure 5:
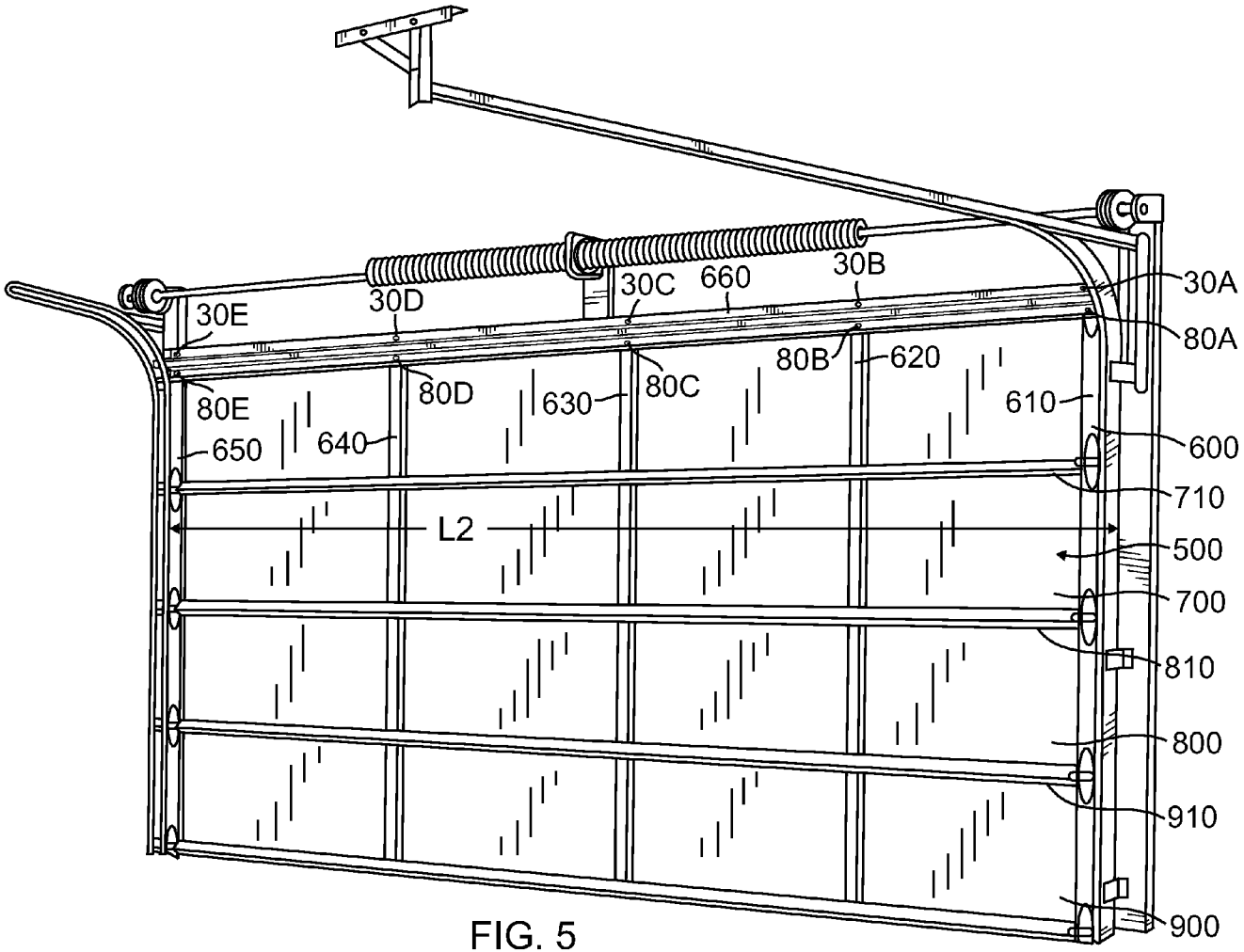
FIG. 5 is a rear perspective view of a garage door with the present invention stiffening strut affixed in place adjacent the top of the upper most panel section of the garage door.
Figure 6:
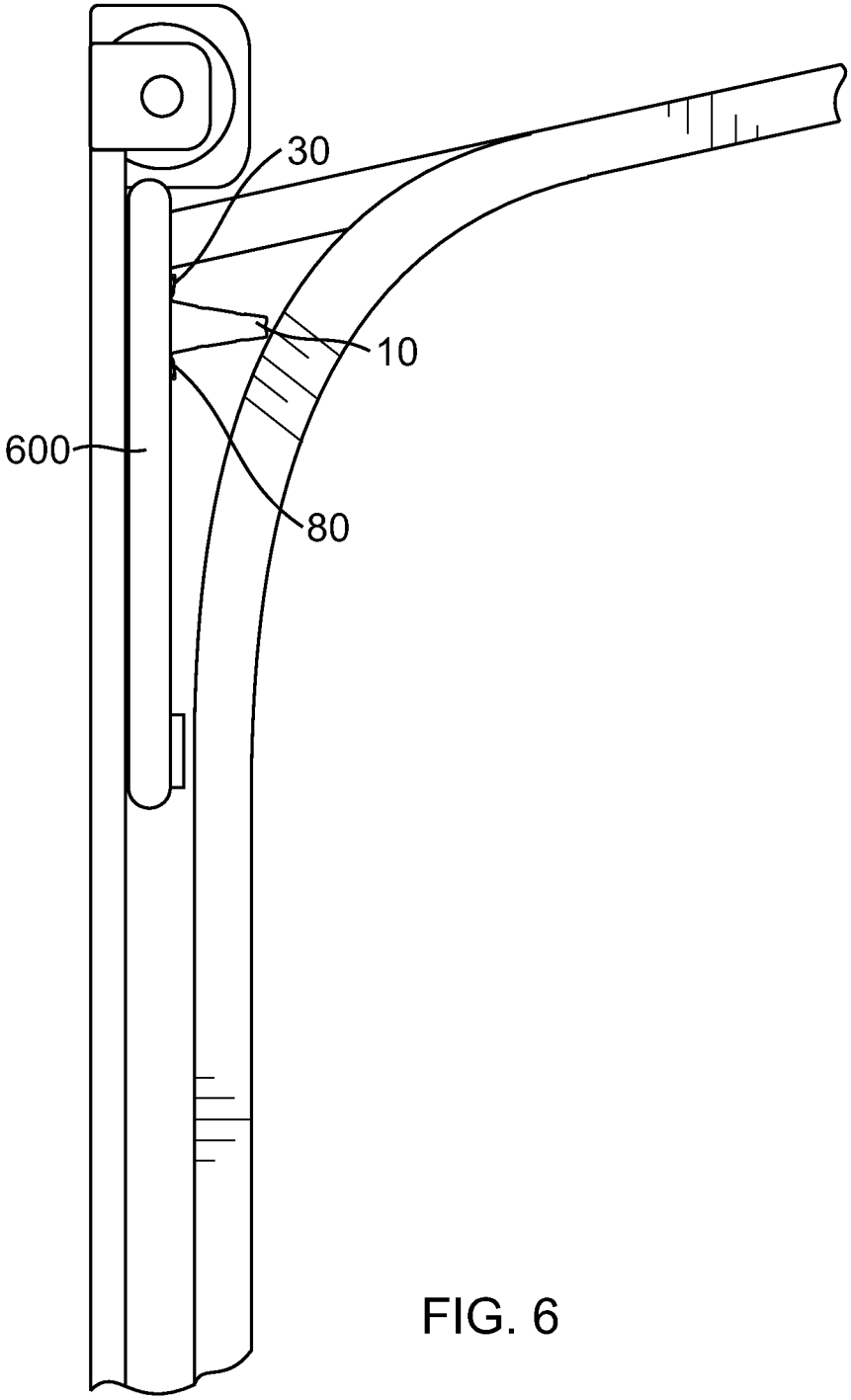
FIG. 6 is an enlarged side elevational view illustrating a portion of the present invention stiffening strut affixed to a portion of the top panel of a garage door.

Referring to FIG. 5, there is illustrated the rear of a garage door 500 comprising four width-wise panels 600, 700, 800 and 900. Each panel is separated from an adjacent panel buy a hinge assembly such hinge assembly 710 separating panels 600 and 700, hinge assembly 810 separating panels 700 and 800 and hinge assembly 910 separating panels 800 and 900 so that the garage door can go up and down by conventional roller tracks. For purposes of the present invention, only the uppermost panel 600 will be discussed in detail. The panel 600 is separated by vertically aligned stiffening stiles, stiffening stile 610 adjacent one end of panel 600, stiffening stile 650 adjacent an opposite end of panel 600, stiffening stile 630 at a midpoint location on panel 600, stiffening stile 630 between stiffening stiles 610 and 630 and stiffening stile 640 between stiffening stiles 630 and 650. A stiffening strut 10 is aligned with the top 660 of uppermost panel 600 so that outer edge 34 of lengthwise mounting sleeve 30 is aligned with 660 so that opening 30A and 80A are aligned with stiffening style 610, openings 30B and 80B are aligned with stiffening stile 620, openings 30C and 80C are aligned with stiffening stile 630, openings 30D ad 80D are aligned with stiffening style 640 and openings 30E and 80E are aligned with stiffening styles 650. Fastening means such as screws or rivets are passed through the openings to affixed to strut 10 to the stiles. FIG. 6 is a side view of the stiffening strut 10 affixed to panel 600. It will be appreciated that the alternative embodiment 110 of the stiffening strut can be affixed to upper panel 600 in the same manner.

Of course the present invention is not intended to be restricted to any particular form or arrangement, or any specific embodiment, or any specific use, disclosed herein, since the same may be modified in various particulars or relations without departing from the spirit or scope of the claimed invention hereinabove shown and described of which the apparatus or method shown is intended only for illustration and disclosure of an operative embodiment and not to show all of the various forms or modifications in which this invention might be embodied or operated.

What is claimed is:

1. A stiffening strut used in conjunction with a rear surface of a top widthwise panel of a garage door panel, said top widthwise panel having a given widthwise length beginning at a first widthwise end and terminating at a second widthwise end, said top widthwise panel including a multiplicity of spaced apart stiffening stiles, at least a first stiffening stile adjacent said first widthwise end of said top widthwise panel and at least a second stiffening stile adjacent said second widthwise end of said top widthwise panel, and at least one stiffening stile between the first and second stiffening stiles, said stiffening strut comprising:

a. a generally U-shaped body having a height in a range from two (2) inches to three (3) inches, a given length approximately equal to said given widthwise length of said top widthwise panel of said garage door panel;

b. a first sidewall with a bottom side edge and a top side edge, a front edge and a rear edge, the bottom side edge extends to first lengthwise mounting sleeve having an interior edge aligned with said bottom side edge, a front edge aligned with the front edge of the first sidewall and a rear edge aligned with the rear edge of the first sidewall, said first lengthwise mounting sleeve having an outer edge parallel to the interior edge of the first lengthwise mounting sleeve, said first lengthwise mounting sleeve having a width in a range from one-quarter (1/4) inch to one-half (1/2) inch, said first lengthwise mounting sleeve having a multiplicity of spaced apart openings, with an opening adjacent the front edge, an opening adjacent the rear edge, and at least one opening between the openings adjacent the respective front edge and rear edge;

c. a pair of parallel spaced apart longitudinal stiffening ribs in the first sidewall, a first stiffening rib having a front edge aligned with front edge of the first sidewall, a rear edge aligned with the rear edge of the first sidewall and extending inwardly toward an interior opening of the stiffening strut by a distance in a range of one-sixteenth (1/16) inch to one-eighth (1/8) inch, a second stiffening rib having a front edge aligned with the front edge of the first sidewall and a rear edge aligned with the rear edge of the first sidewall and extending inwardly toward the interior opening of the stiffening strut by a distance in a range of one-sixteenth (1/16) inch to one-eighth (1/8) inch;

d. a second sidewall with a bottom side edge and a top side edge, a front edge and a rear edge, the bottom side edge extends to a second lengthwise mounting sleeve having an interior edge aligned with said bottom side edge, a front edge aligned with the front edge of the second sidewall and a rear edge aligned with the rear edge of the second sidewall, said second lengthwise mounting sleeve having an outer edge parallel to the interior edge of the second lengthwise mounting sleeve, said second lengthwise mounting sleeve having a width in a range from one-quarter (1/4) inch to one-half (1/2) inch, said second lengthwise mounting sleeve having a multiplicity of spaced apart openings, with an opening adjacent the front edge, an opening adjacent the rear edge, and at least one opening between the openings adjacent the respective front edge and rear edge;

e. a pair of parallel spaced apart longitudinal stiffening ribs in the second sidewall, a first stiffening rib having a front edge aligned with front edge of the second sidewall, a rear edge aligned with the rear edge of the second sidewall and extending inwardly toward the interior opening of the stiffening strut by a distance in a range of one-sixteenth (1/16) inch to one-eighth (1/8) inch, a second stiffening rib having a front edge aligned with the front edge of the second sidewall and a rear edge aligned with the rear edge of the second sidewall and extending inwardly toward the interior opening of the stiffening strut by a distance in a range of one-sixteenth (1/16) inch to one-eighth (1/8) inch; and f. a top formed from an extension of the top side edge of the first sidewall extending inwardly to form part of the top and the top side edge of the second sidewall extending inwardly to form part of the top and integrally formed together along a longitudinal center of the top extending from said front edge of the stiffening strut to the rear edge of the stiffening strut, the top including a central stiffening rib extending from a front edge of the top to a rear edge of the top and extending inwardly and downwardly by a distance in the range of one-sixteenth (1/16) inch to one-eighth (1/8) inch into the opening of the stiffening strut, the central stiffening rib in the top formed along a location where the two inwardly extending top side edges are integrally formed and extending into adjacent locations of said two inwardly extending side edges;

g. whereby said outer edge of said first mounting sleeve is aligned with said top end of said top widthwise panel and said stiffening strut is affixed to the rear of said top widthwise panel of said garage door by fastening means selected from the group consisting of screws and rivets extending through a respective one of the multiplicity of openings in the respective first mounting sleeve and second mounting sleeve and into a respective aligned stiffening stile, the stiffening strut extending away from the back of said top widthwise panel of said garage door.

2. The stiffening strut in accordance with claim 1, further comprising:

a. said first sidewall having a given height and said first stiffening rib in said first sidewall is located at approximately one-third of said given height of said first sidewall and said second stiffening rib in said first sidewall is located at approximately two-thirds of said given height of said first sidewall; and b. said second sidewall having a given height, and said first stiffening rib in said second sidewall is located at approximately one-third of said given height of said second sidewall and said second stiffening rib in said second sidewall is located at approximately two-thirds of said given height of said second sidewall.

3. A stiffening strut used in conjunction with a rear surface of a top widthwise panel of a garage door panel, said top widthwise panel having a given widthwise length beginning at a first widthwise end and terminating at a second widthwise end, said top widthwise panel including a multiplicity of spaced apart stiffening stiles, at least a first stiffening stile adjacent said first widthwise end of said top widthwise panel and at least a second stiffening stile adjacent said second widthwise end of said top widthwise panel, and at least one stiffening stile between the first and second stiffening stiles, said stiffening strut comprising:

a. a generally U-shaped body having a height in a range from two (2) inches to three (3) inches, a given length approximately equal to said given widthwise length of said top widthwise panel of said garage door panel;

b. a first sidewall with a bottom side edge and a top side edge, a front edge and a rear edge, the bottom side edge extends to first lengthwise mounting sleeve having an interior edge aligned with said bottom side edge, a front edge aligned with the front edge of the first sidewall and a rear edge aligned with the rear edge of the first sidewall, said first lengthwise mounting sleeve having an outer edge parallel to the interior edge of the first lengthwise mounting sleeve, said first lengthwise mounting sleeve having a width in a range from one-quarter (1/4) inch to one-half (1/2) inch, said first lengthwise mounting sleeve having a multiplicity of spaced apart openings, with an opening adjacent the front edge, an opening adjacent the rear edge, and at least one opening between the openings adjacent the respective front edge and rear edge;

c. a pair of parallel spaced apart longitudinal stiffening ribs in the first sidewall, a first stiffening rib having a front edge aligned with front edge of the first sidewall, a rear edge aligned with the rear edge of the first sidewall and extending outwardly away from an interior opening of the stiffening strut by a distance in a range of one-sixteenth (1/16) inch to one-eighth (1/8) inch, a second stiffening rib having a front edge aligned with the front edge of the first sidewall and a rear edge aligned with the rear edge of the first sidewall and extending outwardly away from the interior opening of the stiffening strut by a distance in a range of one-sixteenth (1/16) inch to one-eighth (1/8) inch;

d. a second sidewall with a bottom side edge and a top side edge, a front edge and a rear edge, the bottom side edge extends to a second lengthwise mounting sleeve having an interior edge aligned with said bottom side edge, a front edge aligned with the front edge of the second sidewall and a rear edge aligned with the rear edge of the second sidewall, said second lengthwise mounting sleeve having an outer edge parallel to the interior edge of the second lengthwise mounting sleeve, said second lengthwise mounting sleeve having a width in a range from one-quarter (1/4) inch to one-half (1/2) inch, said second lengthwise mounting sleeve having a multiplicity of spaced apart openings, with an opening adjacent the front edge, an opening adjacent the rear edge, and at least one opening between the openings adjacent the respective front edge and rear edge;

e. a pair of parallel spaced apart longitudinal stiffening ribs in the second sidewall, a first stiffening rib having a front edge aligned with front edge of the second sidewall, a rear edge aligned with the rear edge of the second sidewall and extending outwardly away from the interior opening of the stiffening strut by a distance in a range of one-sixteenth (1/16) inch to one-eighth (1/8) inch, a second stiffening rib having a front edge aligned with the front edge of the second sidewall and a rear edge aligned with the rear edge of the second sidewall and extending outwardly away from the interior opening of the stiffening strut by a distance in a range of one-sixteenth (1/16) inch to one-eighth (1/8) inch; and f. a top formed from an extension of the top side edge of the first sidewall extending inwardly to form part of the top and the top side edge of the second sidewall extending inwardly to form part of the top and integrally formed together along a longitudinal center of the top extending from said front edge of the stiffening strut to the rear edge of the stiffening strut, the top including a central stiffening rib extending from a front edge of the top to a rear edge of the top and extending inwardly and downwardly by a distance in the range of one-sixteenth (1/16) inch to one-eighth (1/8) inch into the opening of the stiffening strut, the central stiffening rib in the top formed along a location where the two inwardly extending top side edges are integrally formed and extending into adjacent locations of said two inwardly extending side edges;

g. whereby said outer edge of said first mounting sleeve is aligned with said top end of said top widthwise panel and said stiffening strut is affixed to the rear of said top widthwise panel of said garage door by fastening means selected from the group consisting of screws and rivets extending through a respective one of the multiplicity of openings in the respective first mounting sleeve and second mounting sleeve and into a respective aligned stiffening stile, the stiffening strut extending away from the back of said top widthwise panel of said garage door.

4. The stiffening strut in accordance with claim 3, further comprising:

a. said first sidewall having a given height and said first stiffening rib in said first sidewall is located at approximately one-third of said given height of said first sidewall and said second stiffening rib in said first sidewall is located at approximately two-thirds of said given height of said first sidewall; and b. said second sidewall having a given height, and said first stiffening rib in said second sidewall is located at approximately one-third of said given height of said second sidewall and said second stiffening rib in said second sidewall is located at approximately two-thirds of said given height of said second sidewall.

* * * * *